United States Patent [19]

Gaertner et al.

[11] Patent Number: 4,789,942

[45] Date of Patent: Dec. 6, 1988

[54] INSTALLATION FOR MANUFACTURING DIFFERING MINERAL FIBRE PRODUCTS INCLUDING MANUAL CONTROLS FOR VARYING STORED CONTROL SIGNALS

[75] Inventors: Hans Gaertner, Dannstadt-Schauernheim; Friedrich Kaufmann, Limburgerhof; Horst W. Schlossherr, Dudenhofen; Dietrich Schulz, Ludwigshafen, all of Fed. Rep. of Germany

[73] Assignee: Isover Saint-Gobain, Courbevoie, France

[21] Appl. No.: 52,168

[22] Filed: May 20, 1987

Related U.S. Application Data

[63] Continuation of Ser. No. 663,167, Oct. 22, 1984, abandoned.

[30] Foreign Application Priority Data

Oct. 21, 1983 [DE] Fed. Rep. of Germany ..... 3338359

[51] Int. Cl.[4] ..... G06F 15/46

[52] U.S. Cl. ..... 364/470; 364/146; 364/181; 364/182; 364/188; 364/192

[58] Field of Search ..... 364/140, 142, 146, 181, 364/182, 188, 191–193, 469, 470, 148, 149; 19/240

[56] References Cited

U.S. PATENT DOCUMENTS

| | | | |
|---|---|---|---|
| 4,007,028 | 2/1977 | Bublitz et al. | 364/142 |
| 4,180,860 | 12/1979 | Driscoll et al. | 364/188 |
| 4,189,765 | 2/1980 | Kotalik et al. | 364/188 |
| 4,363,090 | 12/1982 | Garcia | 364/192 |
| 4,418,381 | 11/1983 | Molusis et al. | 364/188 |
| 4,473,924 | 10/1984 | Hartmannsgruber et al. | 364/470 |
| 4,530,134 | 7/1985 | Hösel | 364/470 |
| 4,533,990 | 8/1985 | Takada et al. | 364/146 |
| 4,542,452 | 9/1985 | Fukai et al. | 364/146 |
| 4,601,004 | 7/1986 | Holt et al. | 364/571 |

FOREIGN PATENT DOCUMENTS

| | | |
|---|---|---|
| 2335810 | 1/1974 | Fed. Rep. of Germany . |
| 2450433 | 4/1975 | Fed. Rep. of Germany . |
| 2655848 | 7/1977 | Fed. Rep. of Germany . |

*Primary Examiner*—John R. Lastova

*Attorney, Agent, or Firm*—Oblon, Fisher, Spivak, McClelland, & Maier

[57] ABSTRACT

An installation for the continuous manufacture of differing mineral fiber products, wherein control parameters associated with each fiber product to be manufactured are changed when the production line is to be changed from the production of one product to that of another. For this purpose, the individual control parameters for a new product are first adjusted by hand by means of a reference value adjusting device in the course of a test cycle and thereby optimized. Control signals corresponding to the adjustments thus obtained for a respective fiber product are then stored in a fixed memory and are addressable by means of a common address. If production of the same product is subsequently to be resumed, the set of associated control signals is transferred from the fixed memory to a CPU, whereby the whole production line or an envisaged part of the production line is immediately converted to the new product. Manual correcting devices switchably connected to the CPU in place of the reference value adjustment devices permit fine adjustments to be carried out on the stored reference values as required by the circumstances in each individual case.

4 Claims, 3 Drawing Sheets

INSTALLATION FOR MANUFACTURING DIFFERING MINERAL FIBRE PRODUCTS INCLUDING MANUAL CONTROLS FOR VARYING STORED CONTROL SIGNALS

This application is a continuation of application Ser. No. 663,167, filed on Oct. 22, 1984, now abandoned.

BACKGROUND OF THE INVENTION

1. Field of the Invention

This invention relates to an installation for the continuous manufacture of differing mineral fiber products, wherein a predetermined number of control elements are provided for adjusting specific parameters of the products.

2. Description of the Prior Art

Such an installation for the manufacture of mineral fiber products, commonly referred to as a production line, includes, from the fiber forming apparatus to the packing station, various apparata which act on the mineral fiber product for the purpose of adding binder, compressing the product, hardening it, trimming the width, cutting the length, applying a facing if required, rolling up the product, stacking it and wrapping it. For an example of such a production line and an illustration thereof, reference may be made to the specification of DE-OS No. 3,100,003, while the specifications of DE-OS No. 3,036,816 and DE-OS No. 3,325,341 explain the problems encountered in the application of a facing to such mineral fiber products, and the specification DE-OS No. 3,314,289 deals with the problems relating to the control of a winding station at the end of the production line.

Typically, most of the apparata act on the product in a manner which is specific to the particular product and must therefore be regulated afresh each time the line changes over from one product to another. Such regulation is necessary each time a completely new product is to be manufactured, for example a width of mineral fiber sheet or the like which has not previously been produced, and it is also necessary in cases where products which differ among themselves, although of conventional type, are required to be manufactured alternately. Although the change over to products which have not yet hitherto been manufactured generally occurs only a few times per month, the changeover to the manufacture of different products to meet customers' orders generally occurs at least several times per day and frequently several times per hour, for the successive manufacture of small batches of specially required products.

For this purpose, appropriately adjusted control parameters must be applied to the treatment apparatus of the production line. One then encounters the particular difficulty that the adjusted parameters do not always result in exactly the properties of products envisaged and moreover, different properties may be obtained from one case to the other. If, for example, the intake nip between the press rollers is adjusted to a value of, say, 8 cm, the continuous sheet of mineral fibers will certainly be compressed to a thickness of 8 cm in this position but will subsequently expand elastically to a thickness of, say, 12 cm. This elastic recovery will, however, not invariably expand this same sheet of mineral to precisely the same height but will cause it to assume differing heights according to the consistency of the fibers, the binder content, its degree of hardening, etc. These heights differing from one case to another are liable to influence subsequent treatment operations, for example the winding operation as such, the length of sheet required to wrap around the roll of material, it being understood that other magnitudes which also vary according to circumstances may also intervene, as for example the binder content.

All this has the consequence that an accumulation of unfavorable parameters may result in the production of rejects even when all the parameters over the whole apparatus have been precisely regulated according to the product to be manufactured. In the most unfavorable case, a given adjustment of parameters, which may previously have resulted in a satisfactory product, may during a subsequent passage or a reversion to the same product produce a result which is no longer acceptable because in the meantime other circumstances have intervened to result in an unfavorable accumulation of deviations in the properties of the products.

Furthermore, during the interval of time required for adjusting the parameters of the apparatus, the line will inevitably produce rejects, and this may give rise to the accumulation of a considerable quantity of scrap in cases where conversions are frequent. These rejected quantities are not only lost as marketable commodities, but also entail considerable costs for their removal. The quantity of rejected products will obviously be higher where the persons in charge of the installation are less qualified. Where multiple work shifts exist over a 24 hour period, variations in the qualifications of the staff for each shift are inevitable.

SUMMARY OF THE INVENTION

Accordingly, it is an object of this invention to provide a novel installation for the continuous manufacture of differing products of mineral fibers, wherein plural control elements are provided for adjusting specific parameters of the manufactured products, whereby it will be possible to pass rapidly from the production of one product to another regardless of the qualification of the staff and without any significant production of rejects.

This and other objects are achieved according to the invention by providing a novel installation for the continuous manufacture of differing mineral fiber products, wherein plural control elements are provided for controlling specific parameters of the manufactured products, including plural manually operable reference value adjusting devices for producing respective electric control signals to be applied to the control elements for control thereof, a memory in which the electric control signals are stored as reference values under a common address corresponding to a particular product to be manufactured, whereby the reference values corresponding to particular products are recalled together by addressing the memory with the common address and applied as control signals to the control elements; and manually operable correcting devices for modifying the control signals instantaneously within a preestablished range without modification of the stored reference values.

Where a product is to be manufactured for the first time, the line is controlled manually by highly qualified staff who select the probable adjustments and modify the parameters in the course of a test cycle until the desired quality of product is obtained. The devices for adjusting the reference values are in this case used as simple control elements by means of which rapid variations of adjustment may be carried out and monitored by the qualified staff to produce the desired quality of product by the interplay of individual adjustments along the line. When the desired quality of product has been obtained in this manner, the adjustments obtained are stored as reference values in the static memory. The stored reference values associated with the product in question are retrieved from the memory by accessing the memory with a common address associated with the respective product. All the stored reference values associated with a particular product may thus be commonly recalled at any moment with the aid of the specific common address associated with the product.

The reference values set by the reference value adjustment devices may subsequently be adjusted to mean values, such as when the new product has been in production for some time, e.g. by suitable fine adjustments carried out by highly qualified staff for a relatively long time. This mean value produces in the desired product a product quality which is invariably still acceptable, bearing in mind the range of variations of the parameters to be taken into consideration. In the course of time, less qualified staff may also call out all these mean values together by pressing on a button after the values have been stored in the static memory, so that the whole production line will change over to these predetermined values automatically without any interruption in output or the production of any significant quantities of rejects.

In this case, however, the quality of product obtained on the basis of the freshly recalled reference values may not always be optimum from one case to another although it will still be marketable, and it may progressively vary slightly in the course of production.

Manual correcting devices are provided for carrying out readjustments and optimizing the quality of the product, and these also enable less qualified staff to carry out the necessary readjustments. This possibility of readjustment, however, is limited to a predetermined range, which will effectively exclude gross errors of control. Such readjustments are not introduced into the fixed memory and therefore do not modify the reference values stored therein, which consequently remain available without modification. This ensures that optimazation may be achieved with the aid of the readjustment within a predetermined scope while the basic adjustment for the product always remains available in accordance with the information stored in the fixed memory. One thereby safely prevents additive errors which would be inevitable in the case of multiple adjustments and corresponding storage of the values adjusted each time, in particular when less qualified operators are in charge.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
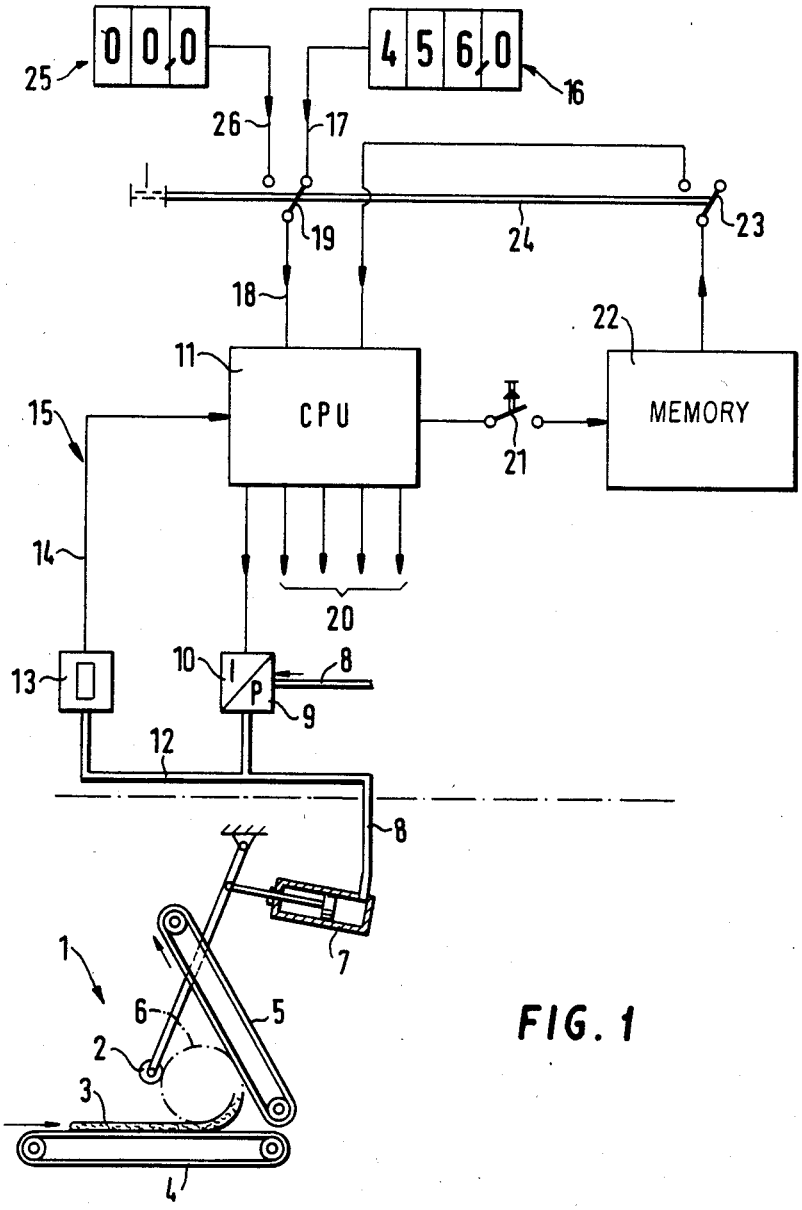
FIG. 1 is a schematic circuit diagram of an installation according to the invention in the zone of a winding station.

Referring now to FIG. 1, reference numeral 1 denotes a winding station as described in more detail, for example, in specification DE-OS No. 3,314,289, which is incorporated by reference herein. As explained in detail in specification DE-OS No. 3,314,289, numerous control operations must be carried out at the time of rolling up the sheets of mineral fibers and wrapping them in such a winding station 1, and they must be finely adjusted to each other to produce a product of optimum quality. Similar control operations and adjustment of the control parameters to each other must be carried out for the preceding operations of such a production line. With regard to these operations, in particular the problems posed by the application of a facing, specifications DE-OS No. 3,036,816 and DE-OS No. 3,325,341 are cited, and the subject matter disclosed in these references is likewise incorporated by reference herein.

The invention is described below, for example, in its application to the control of the carding roller 2 of the winding station 1. In this case, a sheet of mineral fiber 3 is conducted by its front end over a conveyor belt 4 into the winding station 1 where the front end of the sheet of mineral fibers 3 is folded back by a lifting belt 5 to form a roll 6. The carding roller 2 guides the backwardly curved, front end of the sheet of mineral fibers 3 to form the first turn and is then applied under a predetermined pressure to the external surface of the roll 6, which is in the process of formation and increasing in diameter, so that the roller regulates the pressure exerted on the turns of the roll and thus influences the final diameter of the roll produced.

For this purpose, the pressure applied by the carding roller 2 against the periphery of the roll 6 is adjusted by a jack 7, for example a pneumatic jack. A conduit 8 supplies the jack 7 with a medium under pressure from a source of pressure medium (not shown). The conduit 8 contains a control device 9 which regulates the pressure of the pressure medium in the jack 7.

The control device 9 is in turn controlled by an electric control element 10 which receives a control command from a central processing unit, abbreviated CPU, indicated at 11. A feeler conduit 12 is connected to the conduit 8 which carrys pressure medium. This feeler conduit 12 transmits the effective pressure of the pressure agent in conduit 8 to a feeler 13 which is in the form of a measurement transducer, which applies an electric comparison signal to the CPU 11 along an electric line 14, to form a control circuit generally indicated by the reference 15, thereby ensuring that the effective value of the pressure in the jack 7 will correspond to the value set on the control element 10 by the CPU 11.

The control value for the element 10 may be manually adjusted by means of a reference value adjusting device 16 connected to the CPU 11 by way of the electric lines 17 and 18 containing an intermediate reversing switch 19, so that direct adjustment of the control element 10 corresponding to the adjustment of the reference value adjustment device 16 is obtained.

Thus by adjusting the reference value adjustment device 16, the operators may directly modify the pressure in the jack 7 and thus regulate the action of the carding roller 2 on the roll 6 in the desired manner. As indicated schematically by arrows, the CPU 11 supplies not only the control element 10, but also several other control elements 20, for example in the zone of the winding station 1 or in other zones along the production line, with corresponding control data which are fed in by respective reference value adjustment devices 16. Each desired parameter of the production line may thus be adjusted to a chosen value by means of a respective reference value adjustment device 16, the CPU 11 or several central units of this type and corresponding control elements.

For a given product, the production line may thus be controlled to provide the optimum quality of product. For individual parameters, mean values are then introduced into the reference value adjustment devices 16 to allow for deviations in both directions as far as possible without giving rise to production rejects.

All the reference values adjusted at the CPU 11 by way of the reference value control devices 16 may be fed into a fixed memory 22 by actuating a key 21 and stored in the memory 22 under a common address associated with the product which has just been produced. When a similar product is later to be produced again, the output of the fixed memory 22 may be connected to the CPU 11 by a switch 23 while the reference value adjustment devices 16 are disconnected from the CPU 11 by turning the reversing switch 19 by means of a common switching bar 24. When the address associated with a product to be manufactured is read out from the static memory 22, the memory 22 supplies to the CPU 11 the fixed reference values commonly stored under this address, thus automatically ensuring correct adjustment of all the control elements 10 or 20 to the values previously set and memorized. It is therefore possible, in many cases without any interruption in production, to convert the production line immediately to the manufacture of another product which has already been manufactured previously.

It should be understood that sequential conversion of individual control elements 10, 20 may also be carried out in a manner not illustrated in detail, for example by means of appropriate delay elements, so that the new adjustments will not take place simultaneously along the whole production line but one after the other as the head end of the new product passes along the production line.

For the production of mineral fiber products, however, it is found that the same reference values stored in the memory and the corresponding parameter adjustments do not always give rise to the same quality of product but that certain deviations in quality may appear. This is due to the fact that a material consisting of mineral fibers is a product having relatively undefined dimensions so that small variations in the properties of the product may give rise to modifications in the production conditions, which in very unfavorable cases may be additive to give rise to completely different qualities of product in spite of the same settings being used along the production line.

Therefore, a manual correcting device 25 associated with each reference value adjustment device 16 is provided. This manual correcting device 25 is connected to the CPU 11 in place of the corresponding reference value adjustment device 16 when switching over from manual to automatic operation. The switch 19 in that case connects an output line 26 of the manual correcting device 25 in place of the output line 17 of the device 16 to the input line 18 of the CPU 11. The manual correcting device 25 enables a fine adjustment between preestablished limits to be applied to the control signal, which the CPU 11 applies to each control element 10 or 20 in a manner corresponding to the information stored in the fixed memory 22. Thus by altering the adjustment of the manual correcting device 25, the personnel in charge of the installation may attempt to optimize even more finely the quality of the product in relation to the stored mean values. In that case, the manual correcting devices 25 only modify the instantaneous control signal for the associated control element 10 and not the mean value stored independently thereof in the fixed memory 22, which can only be modified by actuating the key 21.

When change over to a new product is required, for example a width of mineral fiber sheet which has not previously been produced, preliminary adjustment of the production line in accordance with the parameters envisaged is carried out by highly qualified staff by means of the individual reference value adjustment devices 16 while the reversing switch 19 between lines 17 and 18 is closed. Final setting of the corresponding reference value adjustment devices 16 is carried out in the course of a test cycle until a mean adjustment for the individual parameters produces the desired quality of product for the new product. This final state is verified by the person responsible and fed into the static memory 22 by actuation of the key 21 to be stored in this memory under the address of the new product. Whenever this new product is subsequently to be produced again, the desired conversion of the whole production line can be ensured simply be reading out the corresponding address from the static memory 22 while switch bar 24 is in the automatic position, and introducing it into the CPU 11. Fine adjustments may subsequently be carried out with the aid of the manual correcting devices 25 which influence the instantaneous control signals applied, to the control elements 10 or 20 but not the fixed values stored in the static memory 22, which can only be modified by actuating the key 21. Such a subsequent adjustment by means of manual correcting devices 25 may, if necessary, be carried out by less qualified staff since the adjustment of the values stored in the memory ensures that a marketable product will always be obtained. Rejects may certainly occur at the beginning of production of a completely new product, as occurs at present with every conversion or changeover of the production line, but the production of rejects is virtually eliminated during subsequent passages of this product along the Z production line.

Figure 2A:
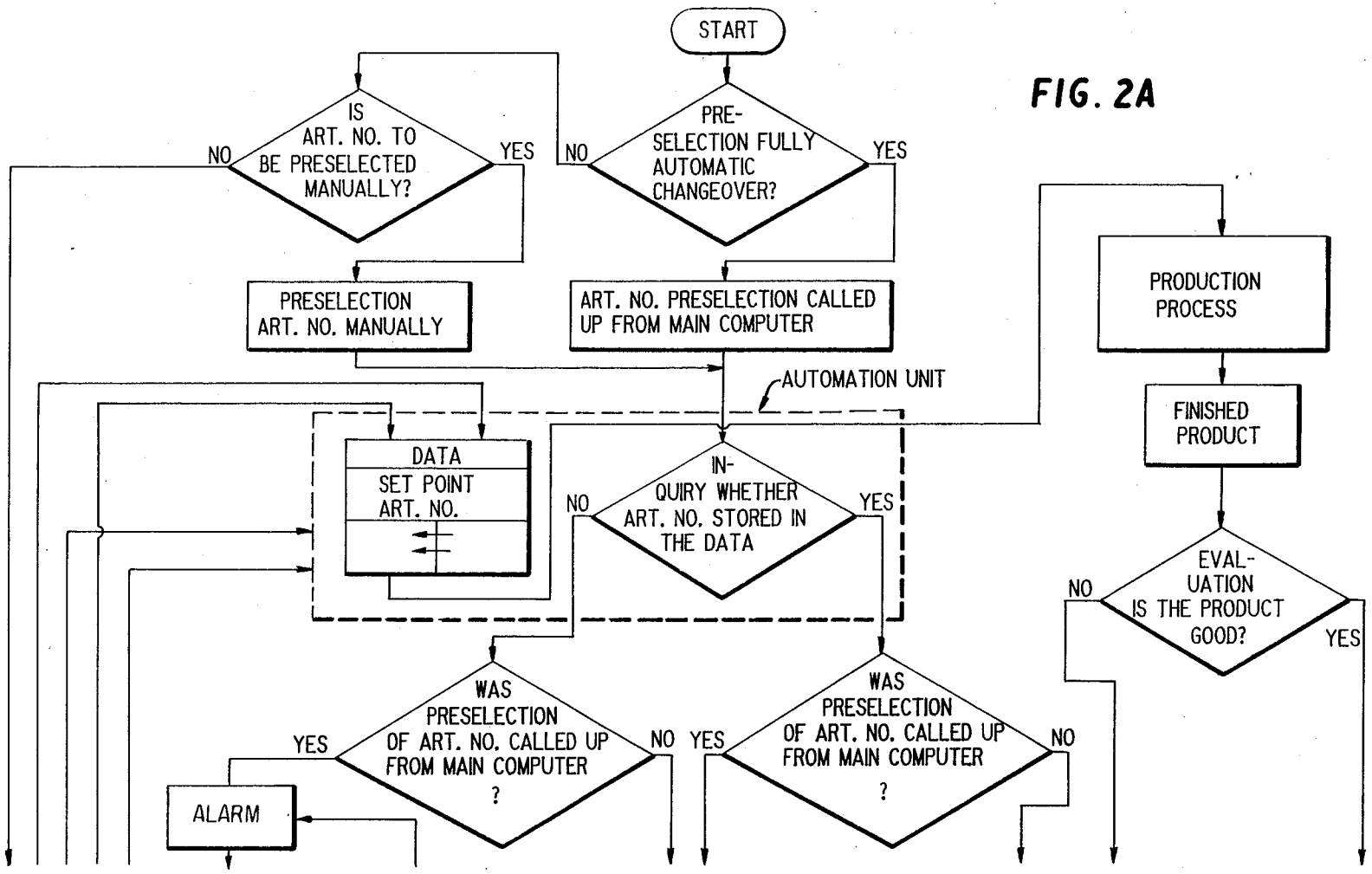
FIGS. 2A and 2B in combination are a flow chart illustrating operation of the installation according to the installation according to the present invention.
Figure 2B:
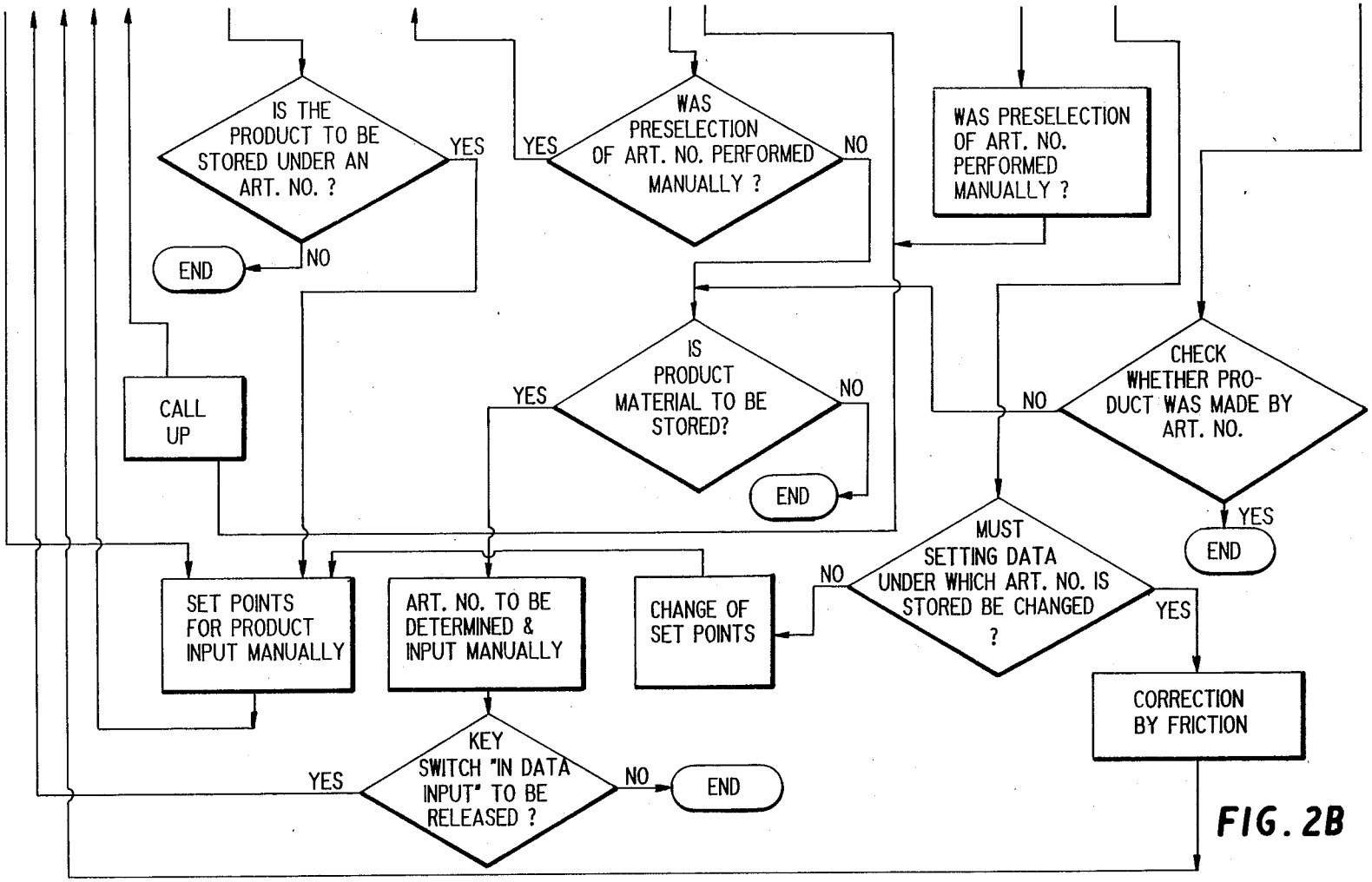

FIGS. 2A and 2B illustrate the operation of the installation of the present invention in flow chart form. Since this operation is readily evident to persons skilled in the art in light of the above description, no further explanation is provided.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An installation for the continuous manufacture of differing mineral fiber products, comprising:

plural control elements each for controlling a parameter of a product;

plural reference value adjusting devices each for producing a control signal to be applied to one of said control elements associated with the adjusting devices;

a memory for commonly storing control signals associated with each product, wherein the control signals associated with each product and stored in said memory are accessed by means of a common address for common retrieval of the control signals associated with each product; and plural manually operable correcting devices for making fine adjustments within pre-established limits to the control signals retrieved from said memory without modification of the stored control signals, thereby to control the quality of each product primarily based on the stored control signals, as finely adjusted by the manually operable correcting devices;

a central processing unit for controlling application of retrieved control signals to said control elements; and switching means disposed between said central processing unit and said memory and said reference value adjusting devices for switching over from a manual operation mode to an automatic operation mode wherein control signals applied to said control elements are derived from said memory instead of said reference value adjusting devices, comprising means for switching an input line to said central processing unit from one of said reference value adjusting devices to one of said correcting devices when said switching means switches over to said automatic operation mode such that said central processing unit receives a correcting signal from said correcting device, modifies a corresponding retrieved control signal received from said memory based on the received correcting signal, and applies the modified control signal to a control element associated with the modified control signal.

2. An installation according to claim 1, further comprising:

feedback control means for producing a feedback signal corresponding to a parameter being controlled by one of said control elements, for comparing the feedback signal with the stored control signal associated with said one control element, and for adjusting the control signal applied to said one control element in correspondence with a difference between the feedback and stored control signals.

3. An installation according to claim 1, comprising:

means for producing a common storage command to be applied to said memory such that each of said control signals commonly associated with a product is simultaneously stored in said memory upon production of said common storage command.

4. An installation according to claim 2, comprising:

means for producing a common storage command to be applied to said memory such that each of said control signals commonly associated with a product is simultaneously stored in said memory upon production of said common storage command.

* * * * *